US009543723B1

(12) United States Patent
Steen

(10) Patent No.: US 9,543,723 B1
(45) Date of Patent: Jan. 10, 2017

(54) TRAILER LIGHT HARNESS CLEANER

(71) Applicant: Sidney Steen, Georgetown, SC (US)

(72) Inventor: Sidney Steen, Georgetown, SC (US)

( * ) Notice: Subject to any disclaimer, the term of this patent is extended or adjusted under 35 U.S.C. 154(b) by 0 days.

(21) Appl. No.: 14/823,017

(22) Filed: Aug. 11, 2015

(51) Int. Cl.
*H01R 43/00* (2006.01)
*B24D 15/00* (2006.01)
*B08B 1/00* (2006.01)

(52) U.S. Cl.
CPC ..... *H01R 43/002* (2013.01); *B08B 1/006* (2013.01)

(58) Field of Classification Search
CPC ..... B24D 15/04; B24D 15/023; B24D 15/00; B08B 1/006; H01R 43/002; A46B 3/18
USPC ..... 451/523
See application file for complete search history.

(56) References Cited

U.S. PATENT DOCUMENTS 1,763,561 A * 6/1930 Mulder ..... H01R 43/14 451/418
2,734,320 A * 2/1956 Hoye ..... B24D 15/02 451/524
3,504,459 A * 4/1970 Spiteri ..... H01R 9/00 451/525
3,557,496 A * 1/1971 Martin ..... B24D 15/04 451/523
3,719,460 A * 3/1973 Brockman ..... B24D 15/00 401/195
4,001,982 A * 1/1977 Griffin ..... B24D 15/00 451/552
4,204,294 A 5/1980 Halverson
4,310,941 A * 1/1982 Smith ..... A46B 13/02 15/160
4,575,892 A * 3/1986 Ross ..... A46B 9/02 15/104.04
4,621,461 A * 11/1986 Martin ..... A63B 37/0002 29/235
4,740,169 A 4/1988 Gordon
5,144,775 A * 9/1992 Bakanowsky, III . H01R 43/002 15/210.1
5,513,411 A 5/1996 Simon
5,791,005 A 8/1998 Grabowski
6,196,898 B1 * 3/2001 Naghi ..... G06F 3/039 451/28
6,701,566 B2 3/2004 Rooke
7,354,336 B1 4/2008 Lalancette
D594,418 S 6/2009 Fujino
8,296,893 B2 10/2012 Vinci
9,059,553 B2 * 6/2015 Vinci ..... H01R 43/002
2007/0289606 A1 * 12/2007 Abrahamian ..... B08B 1/00 134/6

(Continued)

FOREIGN PATENT DOCUMENTS

WO WO2012051378 A2 4/2012

*Primary Examiner* — George Nguyen
(74) *Attorney, Agent, or Firm* — Kyle A. Fletcher, Esq.

(57) ABSTRACT

The trailer light harness cleaner includes a plunger that is affixed to an insert, which slides back and forth within an outer sleeve. The insert includes at least one sanding element that is adapted to sand against an electrical terminal of a trailer light harness. The insert is either male-oriented or female-oriented so as to adaptively clean either a male or female light harness. The sleeve is adapted to interface with a light harness, whereas the insert is able to slide back and forth in order for the at least one sanding element to adaptively clean terminals associated with the respective light harness.

17 Claims, 7 Drawing Sheets

(56) References Cited

U.S. PATENT DOCUMENTS

2012/0090114 A1* 4/2012 Keefe ..... B08B 1/00
15/105

* cited by examiner

TRAILER LIGHT HARNESS CLEANER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of vehicular trailers, more specifically, a device that is adapted to clean the terminals of a trailer light harness.

SUMMARY OF INVENTION

The trailer light harness cleaner includes a plunger that is affixed to an insert, which slides back and forth within an outer sleeve. The insert includes at least one sanding element that is adapted to sand against an electrical terminal of a trailer light harness. The insert is either male-oriented or female-oriented so as to adaptively clean either a male or female light harness. The sleeve is adapted to interface with a light harness, whereas the insert is able to slide back and forth in order for the at least one sanding element to adaptively clean terminals associated with the respective light harness. Optionally, the insert may be secured to the outer sleeve and the entire assembly manipulated back and forth in order to remove corrosion on the terminals.

It is an object of the invention to provide a device that includes an insert that is adapted to interface with a trailer light harness in order to clean off terminals that are otherwise corroded.

A further object of the invention is for the device to include a male-oriented insert as well as a female-oriented insert that are collectively able to clean off all trailer wire harness components.

It is a further object of the invention for the device to utilize at least one sanding element that is adapted to engage against the terminal of a corresponding trailer light harness in order to clean any corrosion on the terminal of the trailer light harness.

These together with additional objects, features and advantages of the trailer light harness cleaner will be readily apparent to those of ordinary skill in the art upon reading the following detailed description of the presently preferred, but nonetheless illustrative, embodiments when taken in conjunction with the accompanying drawings.

In this respect, before explaining the current embodiments of the trailer light harness cleaner in detail, it is to be understood that the trailer light harness cleaner is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the trailer light harness cleaner.

It is therefore important that the claims be regarded as including such equivalent construction insofar as they do not depart from the spirit and scope of the trailer light harness cleaner. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
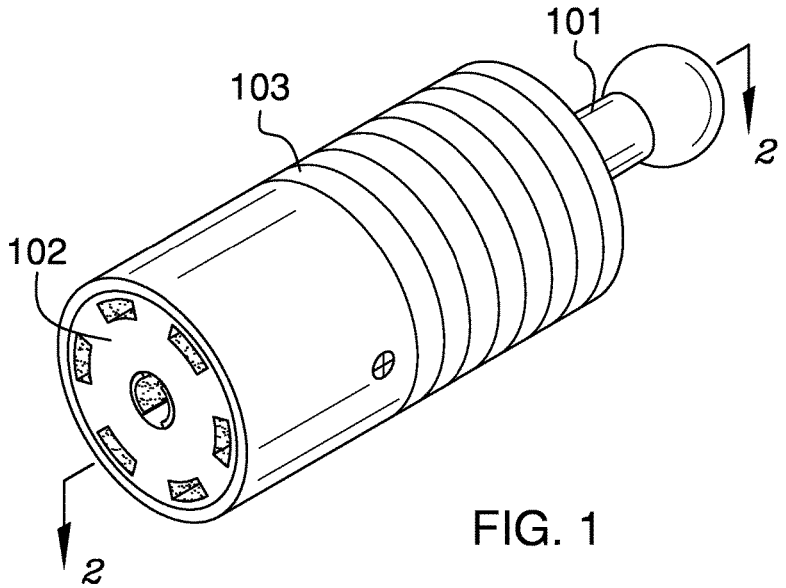
FIG. 1 is a perspective view of an embodiment of the disclosure.
Figure 2:
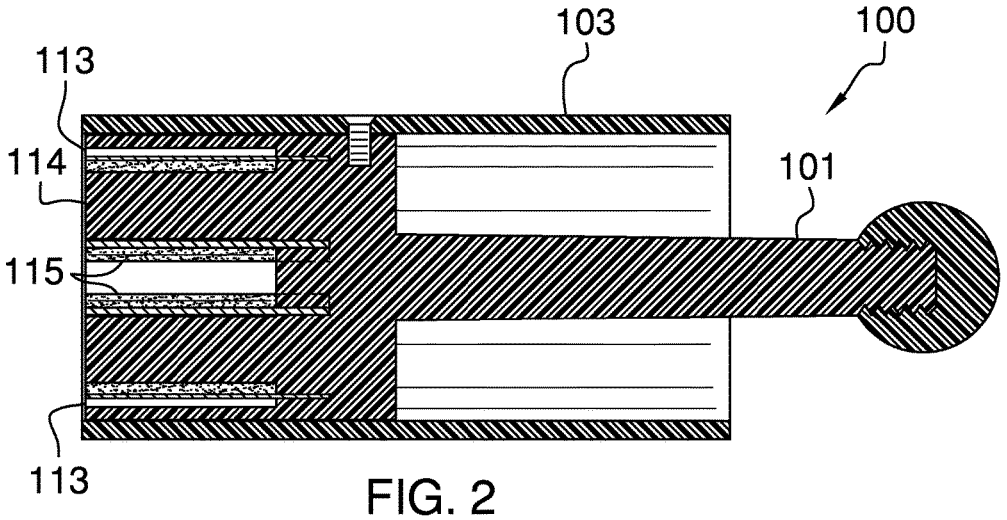
FIG. 2 is a cross-sectional view of an embodiment of the disclosure along line 2-2 in FIG. 1.
Figure 3:
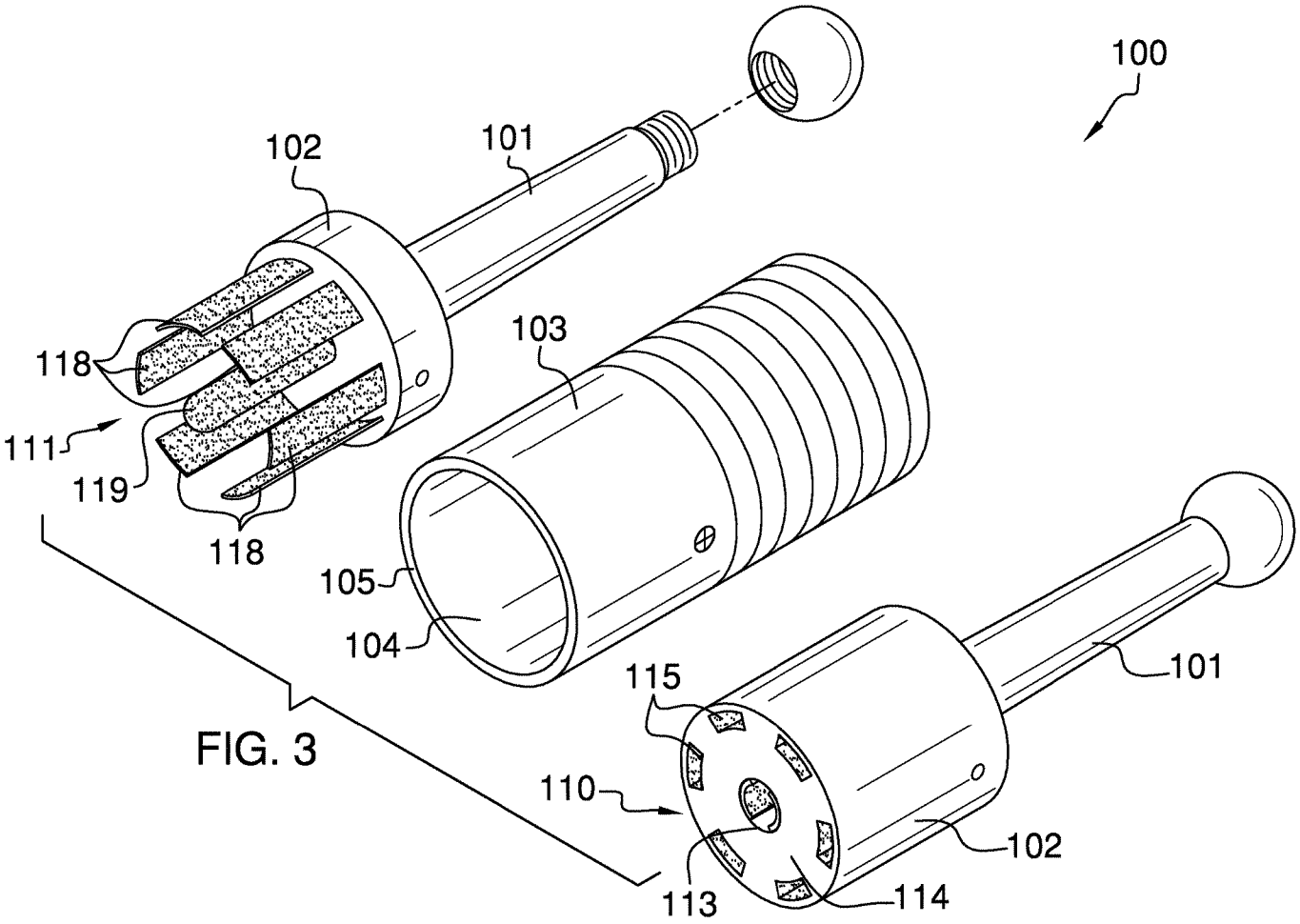
FIG. 3 is a perspective view of alternative embodiments of the disclosure.
Figure 4:
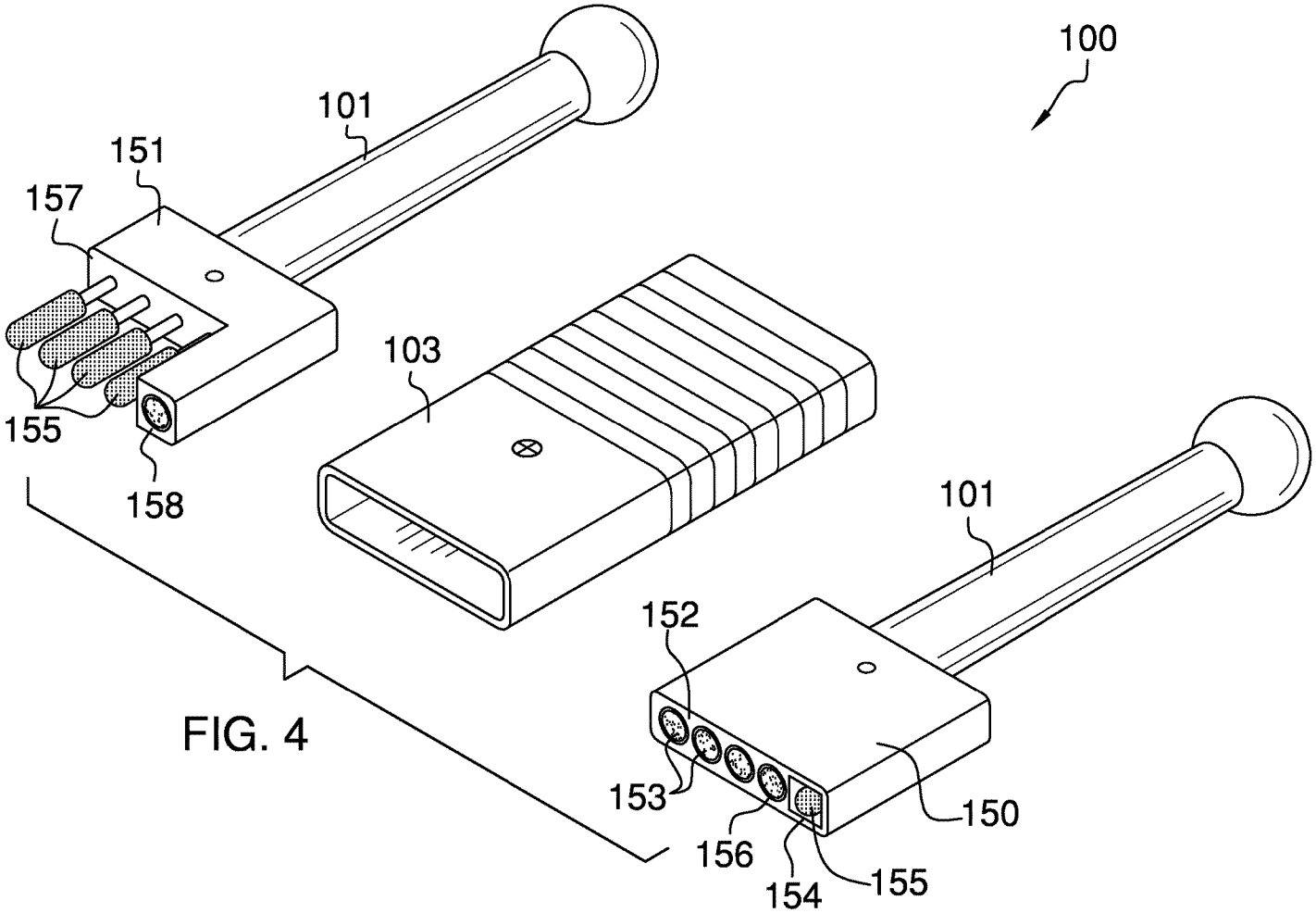
FIG. 4 is a perspective view of alternative embodiment of the disclosure.
Figure 7:
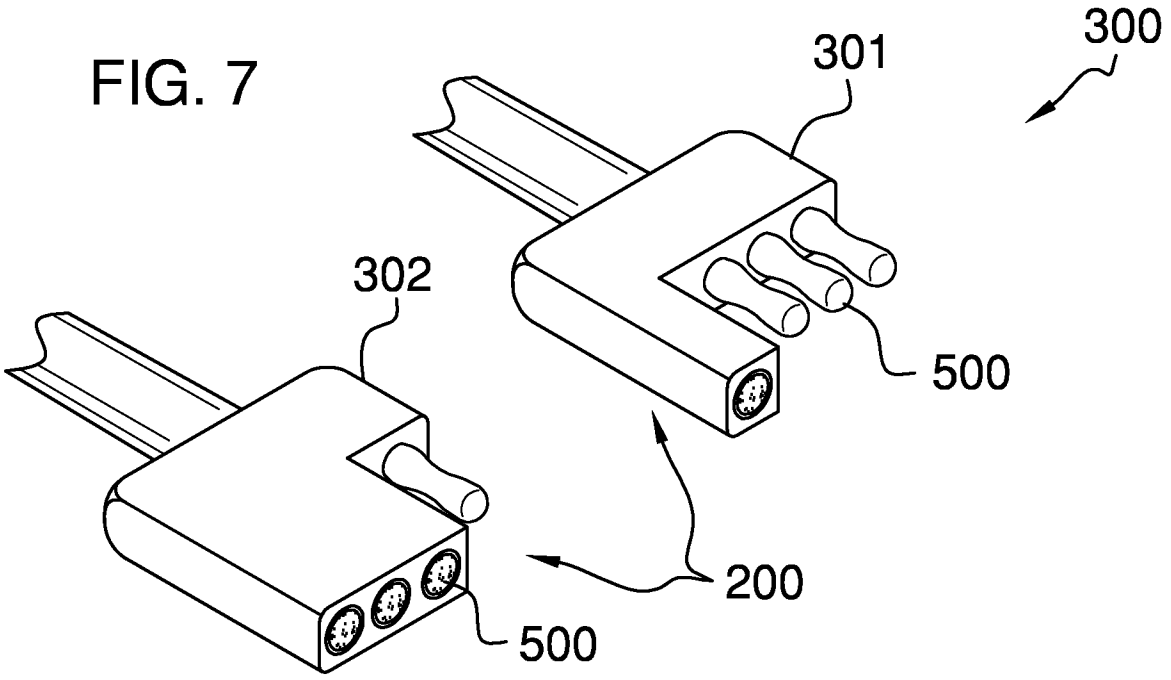
FIG. 7 is a view of a set of trailer light harnesses.
Figure 8:
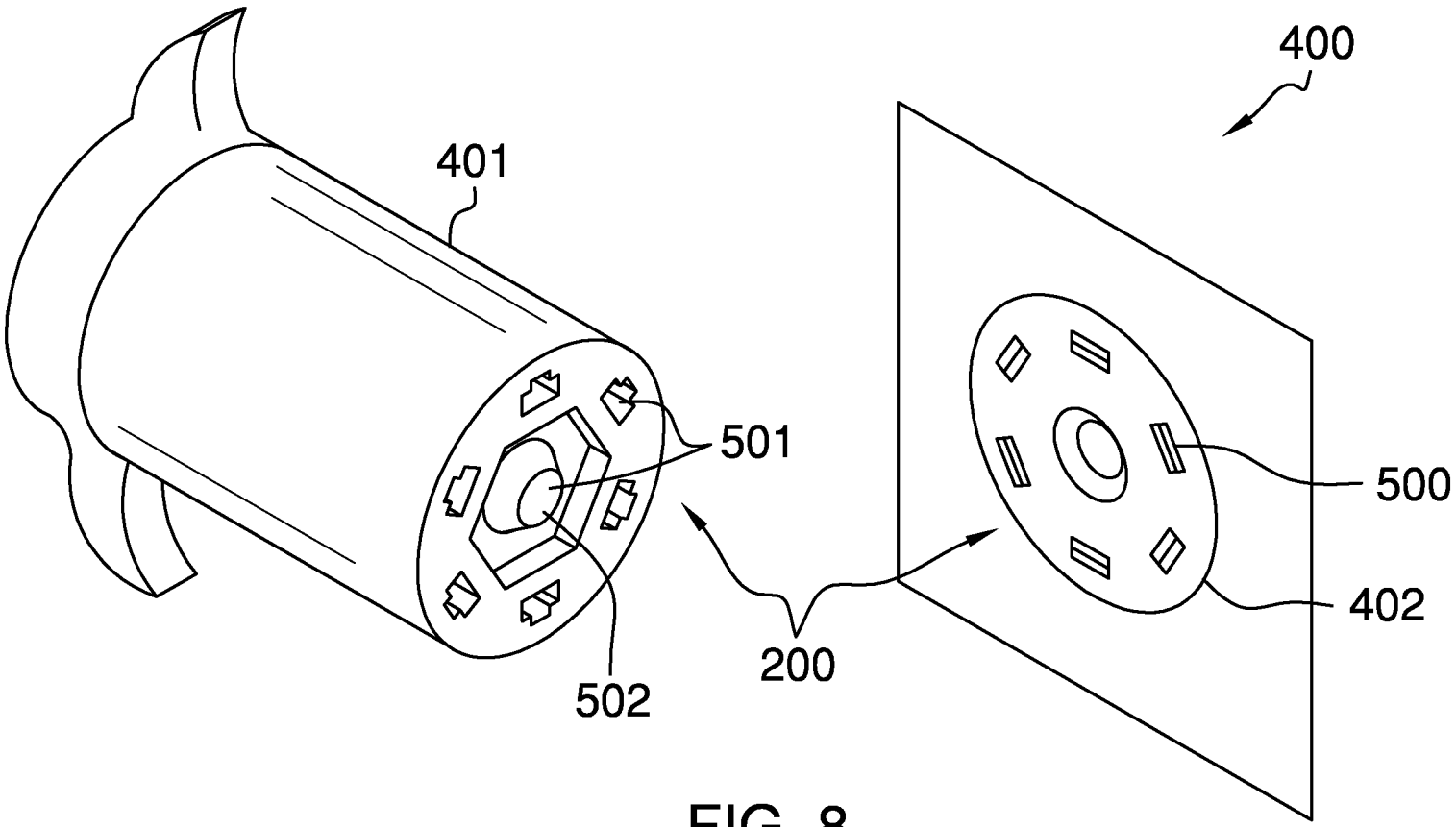
FIG. 8 is a view of another set of trailer light harnesses.

Detailed reference will now be made to a first potential embodiment of the disclosure, which is illustrated in FIGS. 1 through 8. The trailer light harness cleaner 100 (hereinafter invention) comprises a plunger 101 affixed to an insert 102, which is slideably engaged within an outer sleeve 103. Referring to FIGS. 3 and 4, the geometries associated with the invention 100 will vary depending on the applicable type of trailer light harness in use. Referring to FIGS. 7-8, trailer light harnesses come in a variety of shapes, and types. FIG. 7 depicts a 4-way flat wiring bracket 300, which includes a flat male harness 301, and a flat female harness 302. FIG. 8 depicts a 7-way wiring bracket 400, which includes a 7-way male harness 401, and a 7-way female harness 402.

The invention 100 is adapted to work with either the 4-way flat wiring bracket 300 of FIG. 7 or the 7-way wiring bracket 400 of FIG. 8. In either scenario, the invention 100 includes the plunger 101, the insert 102, and the outer sleeve 103. The main difference is that the shape of the insert 102 and the outer sleeve 103 varies depending on the type of wiring bracket being cleaned. It shall be noted that the main objective of the invention 100 is to clean off corrosion on terminals 500 provided on the 4-way flat wiring bracket 300 as well as the 7-way wiring bracket 400. The 4-way flat wiring bracket 300 and the 7-way wiring bracket 400 may be referred to as wiring bracket 200.

Referring to the invention 100 in FIG. 3, the outer sleeve 103 is a hollowed cylinder that is further defined with an inner surface 104 and a first distal end 105. Both, the inner surface 104 and the first distal end 105 are adapted to interface with the wiring bracket 200 as well as the insert 102. The insert 102 may be further defined as a male-oriented insert 110 or a female-oriented insert 111. The difference between the male-oriented insert 110 from the female-oriented insert 111 is that the male-oriented insert 110 is adapted to interface with the 7-way male harness 401 whereas the female-oriented insert 111 is adapted to interface with the 7-way female harness 402.

The male-oriented insert 110 includes a plurality of recesses 113 on a forward face 114. The plurality of recesses 113 are arranged to form a pattern consistent with the 7-way female harness 402. Moreover, the plurality of recesses 113 each includes at least one sanding element 115 therein. The at least one sanding element 115 is adapted to sand off corrosion from the applicable terminal 500.

The female-oriented insert 111 includes a plurality of multi-sided sanding elements 118 as well as a central sanding pin 119. The plurality of multi-sided sanding elements 118 and the central sanding pin 119 are arranged to form a pattern consistent with the 7-way male harness 401. Moreover, the plurality of multi-sided sanding elements 118 are adapted to slide into a terminal slot 501 provided on the 7-way male harness 401. The central sanding pin 119 is adapted to sand off corrosion from a central terminal 502 of the 7-way male harness 401.

Figure 5:
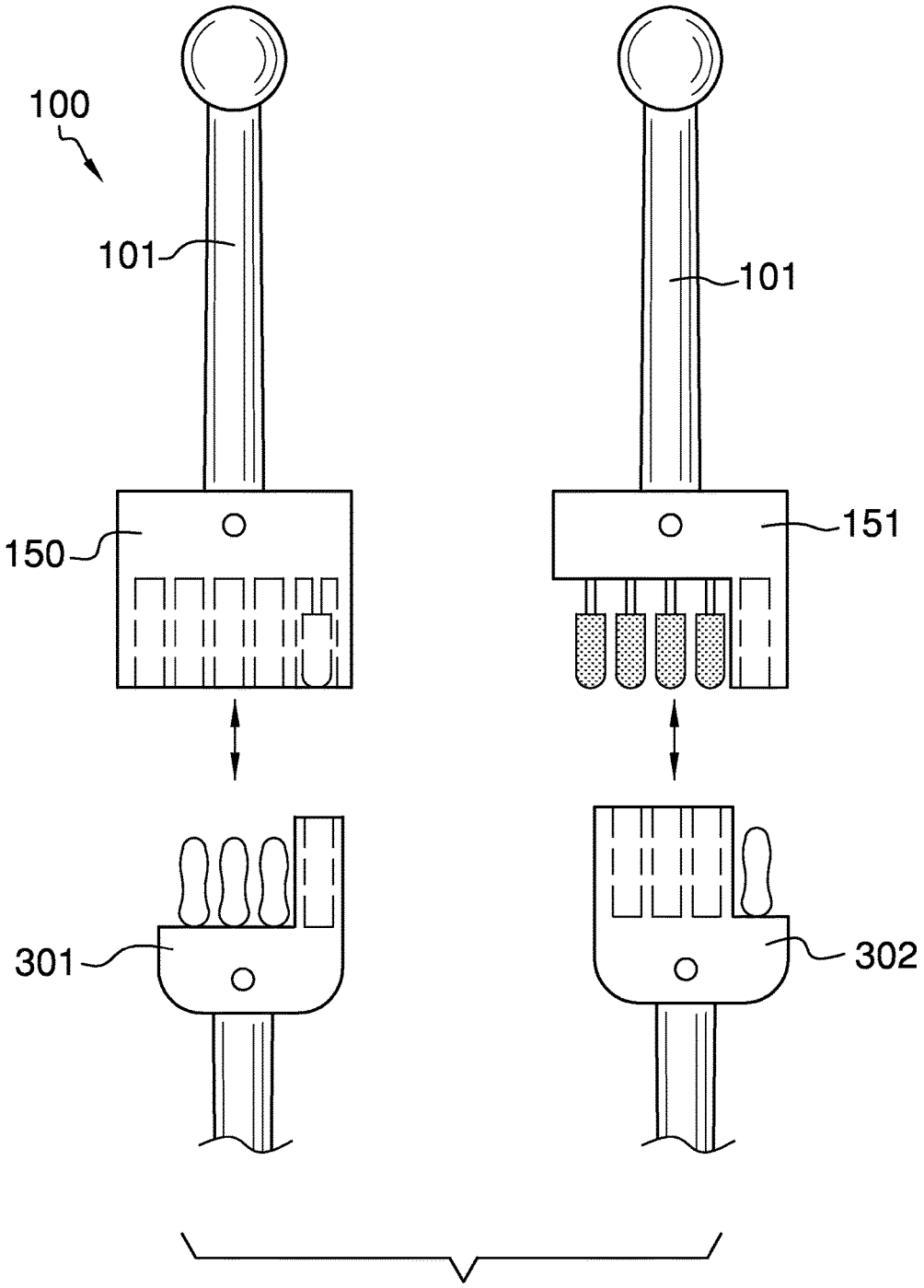
FIG. 5 is a top view of alternative embodiments of the disclosure.
Figure 6:
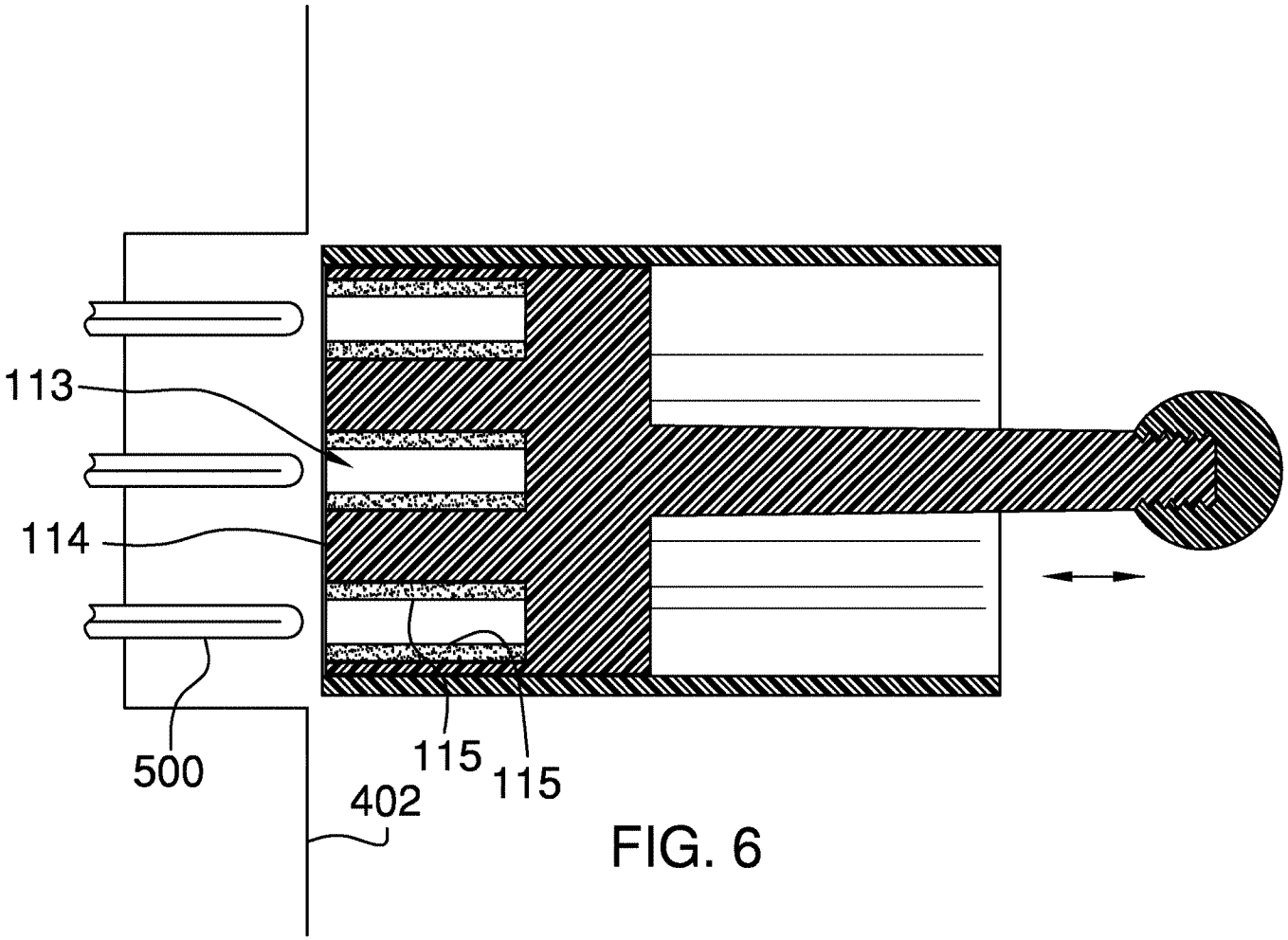
FIG. 6 is a detail view of an embodiment of the disclosure in use.

Referring to FIGS. 4 and 5, the insert 102 may be further defined as a flat female insert 150 and a flat male insert 151. The flat female insert 150 is adapted to interface with the flat male harness 301; whereas the flat male insert 151 is adapted to interface with the flat female harness 302.

The flat female insert 150 is further defined with a fourth face 152 that includes a plurality of flat recesses 153. The flat recesses 153 are linearly aligned along the fourth face 152. A fifth recess 154 is provided on the fourth face 152. The fifth recess 154 is adjacent to the plurality of flat recesses 153. The flat female insert 150 includes a male cleaning brush 155 in the fifth recesses 154. The plurality of flat recesses 153 includes a sanding element 156 therein. The cleaning brush 155 and the sanding element 156 of the plurality of flat recesses 153 are collectively adapted to correspond with and clean the flat male harness 301.

The flat male insert 151 includes a plurality of cleaning brushes 155 linearly aligned along a sixth distal end 157 of the flat male insert 151. The flat male insert 151 also includes a sanding tube 158 that extends from the sixth distal end 157. The sanding tube 158 is linearly aligned with the cleaning brushes 155. The sanding tube 158 includes a sanding element 156 therein. The sanding tube 158 and the plurality of cleaning brushes 155 are collectively adapted to correspond with and clean the flat female harness 302.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A trailer light harness cleaner comprising:

a plunger, an insert, and an outer sleeve;

wherein the insert includes at least one sanding element that is adapted to engage a terminal of a trailer light harness in order to clean off corrosion on said terminal;

wherein the outer sleeve is a hollowed cylinder that is further defined with an inner surface and a first distal end; wherein both the inner surface and the first distal end are adapted to interface with the trailer light harness as well as the insert.

2. The trailer light harness cleaner according to claim 1 wherein the insert is further defined as a male-oriented insert or a female-oriented insert; wherein the male-oriented insert is adapted to interface with a 7-way male harness; wherein the female-oriented insert is adapted to interface with the 7-way female harness.

3. The trailer light harness cleaner according to claim 2 wherein the male-oriented insert includes a plurality of recesses on a forward face; wherein the plurality of recesses are arranged to form a pattern consistent with the 7-way female harness.

4. The trailer light harness cleaner according to claim 3 wherein the plurality of recesses each include the at least one sanding element therein; wherein the at least one sanding element is adapted to sand off corrosion from the applicable terminal.

5. The trailer light harness cleaner according to claim 4 wherein the female-oriented insert is further defined to include a plurality of multi-sided sanding elements as well as a central sanding pin.

6. The trailer light harness cleaner according to claim 5 wherein the plurality of multi-sided sanding elements and the central sanding pin are arranged to form a pattern consistent with the 7-way male harness.

7. The trailer light harness cleaner according to claim 6 wherein the plurality of multi-sided sanding elements are adapted to slide into a terminal slot provided on the 7-way male harness; wherein the central sanding pin is adapted to sand off corrosion from a central terminal of the 7-way male harness.

8. The trailer light harness cleaner according to claim 1 wherein the insert is further defined as a flat female insert or a flat male insert.

9. The trailer light harness cleaner according to claim 8 wherein the flat female insert is adapted to interface with a flat male harness; wherein the flat male insert is adapted to interface with a flat female harness.

10. The trailer light harness cleaner according to claim 9, wherein the flat female insert is further defined with a fourth face that includes a plurality of flat recesses; wherein the flat recesses are linearly aligned along the fourth face.

11. The trailer light harness cleaner according to claim 10 wherein a fifth recess is provided on the fourth face.

12. The trailer light harness cleaner according to claim 11 wherein the fifth recess is adjacent to the plurality of flat recesses.

13. The trailer light harness cleaner according to claim 12 wherein the flat female insert includes a male cleaning brush in the fifth recesses.

14. The trailer light harness cleaner according to claim 13 wherein the plurality of flat recesses include a sanding element therein; wherein the cleaning brush and the sanding element of the plurality of flat recesses are collectively adapted to correspond with and clean the flat male harness.

15. The trailer light harness cleaner according to claim 14 wherein the flat male insert includes a plurality of cleaning brushes linearly aligned along a sixth distal end of the flat male insert.

16. The trailer light harness cleaner according to claim 15, wherein the flat male insert is further defined with a sanding tube that extends from the sixth distal end.

17. The trailer light harness cleaner according to claim 16 wherein the sanding tube is linearly aligned with the cleaning brushes; wherein the sanding tube includes a sanding element therein; wherein the sanding tube and the plurality of cleaning brushes are collectively adapted to correspond with and clean the flat female harness.

* * * * *